US005244357A

United States Patent [19]

Bauer

[11] Patent Number: 5,244,357

[45] Date of Patent: Sep. 14, 1993

[54] METHOD FOR CONTINUOUS CONTROL OF DELIVERY RATE OF RECIPROCATING COMPRESSORS AND DEVICE FOR CARRYING OUT THE METHOD

[75] Inventor: Friedrich Bauer, Vienna, Austria

[73] Assignee: Hoerbiger Ventilwerke Aktiengesellshaft, Vienna, Austria

[21] Appl. No.: 961,058

[22] Filed: Oct. 14, 1992

Related U.S. Application Data

[63] Continuation of Ser. No. 666,191, Mar. 7, 1991, abandoned.

[30] Foreign Application Priority Data

Mar. 16, 1990 [AT] Austria ..... 629/90

[51] Int. Cl.[5] ..... F04B 49/00

[52] U.S. Cl. ..... 417/298; 417/286

[58] Field of Search ..... 417/253, 286, 287, 298

[56] References Cited

U.S. PATENT DOCUMENTS

| | | | |
|---|---|---|---|
| 2,907,344 | 10/1959 | Sochting et al. . | |
| 4,178,137 | 12/1979 | Brotherston | 417/253 |
| 4,364,714 | 12/1982 | Zimmern | 417/286 |
| 4,388,046 | 6/1983 | Boller | 417/298 |
| 4,389,168 | 6/1983 | Yannascoli et al. | 417/298 |
| 4,632,145 | 12/1986 | Machu | 417/298 |
| 4,730,987 | 3/1988 | Kawai et al. | 417/298 |
| 4,869,289 | 9/1989 | Hrabal | 417/298 |

FOREIGN PATENT DOCUMENTS

| | | | |
|---|---|---|---|
| 187616 | 11/1956 | Austria . | |
| 0093694 | 6/1982 | Japan | 417/286 |

OTHER PUBLICATIONS

English abstract of JP-A-52-98207, Aug. 1977.
English abstract of JP-A-6075782, Apr. 1985.
English abstract of SU-1155885-A, May 1985.

*Primary Examiner*—Richard A. Bertsch
*Assistant Examiner*—Alfred Basichas
*Attorney, Agent, or Firm*—Watson, Cole, Grindle & Watson

[57] ABSTRACT

Method for the continuous control of the delivery rate of reciprocating compressors by occasional holding-open of the suction valves by a lifting device (8), which is actuated by a lifting force supplied by a pressure medium. In order to take into consideration the properties of the gas delivered and to adapt the control method in a corresponding manner, the magnitude of the lifting force is chosen depending on the drive power respectively received by the drive motor (11) of the compressor (3). The lifting force may be limited depending on the drive power. An apparatus for carrying out the method includes a compressor system (3), which includes at least one cylinder (4–7) with a lifting device (8) for the suction valve, which is actuated by a lifting force applied by a pressure medium, the magnitude of which can be determined by a controller (10). The drive power received by the drive motor (11) of the compressor (3) is supplied to the controller (10) as a signal. Advantageously, the controller (10) receives a control signal as the reference value and the drive power of the drive motor (11) as an actual value. From the difference between these two signals, the controller (10) forms the lifting force, which then has the effect that the actual value is brought closer to the reference value.

10 Claims, 4 Drawing Sheets

N
Q
P
100%
90%
80%
70%
60%
50%
40%
100%
80%
60%
40%
20%
1.8
2.0
2.2
2.4
2.6
2.8
3.0
3.2
3.4
3.6
3.8bar
1
2
A
A'
B
B'
C
P1
P2

METHOD FOR CONTINUOUS CONTROL OF DELIVERY RATE OF RECIPROCATING COMPRESSORS AND DEVICE FOR CARRYING OUT THE METHOD

This application is a continuation of application No. 07/666,191 filed Mar. 7, 1991, now abandoned.

BACKGROUND OF THE INVENTION

The invention relates to a method for the continuous control of the delivery rate of reciprocating compressors by occasional holding-open of the suction valves by means of a lifting device, which is actuated by a lifting force supplied by a pressure medium. Furthermore, the invention relates to a device for carrying out the method, with a compressor installation, which comprises at least one cylinder with a lifting device for the suction valve, which is actuated by a lifting force applied by a pressure medium. The magnitude of the lifting force can be determined by a controller.

Control methods of this type and devices for carrying out the methods are already known in several constructions and described, for example, in AT-PS 187 616. In these methods, known as "return flow control," a part of the gas sucked in at the time of the compression stroke of the compressor is pushed back again into the suction line due to the suction valve which is held open positively. The suction valve is closed first as soon as the return flow forces exerted on the closure member of the suction valve by the gas flowing back overcome the holding-open force applied from outside. The compression and consequently the conveyance of the medium begin, upon each compression stroke, only after closing of the suction valve. The holding-open force is applied by a pressure medium in the form of a lifting pressure by way of the lifting device to the closure member of the suction valve. By varying the lifting pressure, the respective delivery rate can be chosen, varied and adapted to the respective requirement.

These controls operate substantially without power losses and allow an infinite variation of the delivery rate. Their control range is however limited at the bottom end due to the operation of the reciprocating compressor. With a certain throttled delivery rate, the return flow forces occurring are no longer sufficient to close the suction valve against the lifting force. The compressor then passes abruptly into the idling state. In practice, the lower limit of the control range of such return flow controls lies at approximately 20 to 40% of the full delivery rate. The sudden shutting-off of the delivery is undesirable, since it may lead to considerable fluctuations of the pressure and of the compressed gas quantity in the pressure system supplied and may cause adverse oscillations, which in turn places a pulsating load on the drive motor and in the case of an electrical drive leads to current surges in the mains.

In order to remedy this, it is known to limit the lifting force to a certain value, which is lower than the lifting force necessary for shutting off the delivery. This limit can be ascertained empirically in a relatively simple manner or even calculated. However, it depends largely on the operating conditions of the compressor and on its design, in addition to the construction, above all on the nature of the medium delivered, in particular on its density. It follows from this that the maximum admissible lifting force can in each case be preset in an optimum manner solely for a certain type of gas and a certain suction pressure.

If the nature of the gas, for example its molecular weight, or the suction pressure vary during the operation, the shut-off barrier no longer functions. Since the lifting force necessary increases with the gas density, the limit value can always be coordinated solely with the resulting gas with the lowest density. However, in the case of delivery of a gas of greater density, the full control range can no longer be utilised, because a lifting force higher than the preset limit value would be necessary for this.

In principle it is possible to measure the gas density in the suction state continuously and to adapt the limit value for the lifting force, during operation, continuously to the measured values. However, determining the gas density is complicated and therefore uneconomical. It depends on the intake pressure, the intake temperature and on the molecular weight of the gas. The intake pressure and temperature are simple to measure, but the measurement of the molecular weight is substantially more complicated. The additionally required linkage of the measured values determining the gas density leads to further complications. In practice, this measure is therefore used only seldom.

It is the object of the invention to provide an improved control method of the aforementioned type, in which the control range can be largely utilised independently of the molecular weight of the respective gas delivered, so that the control method can be used advantageously even when delivering gases having a different or varying molecular weight.

SUMMARY OF THE INVENTION

This object is achieved with the method according to the invention due to the fact that at least in the range of the lowest delivery rate which can be achieved by the control, the magnitude of the lifting force is chosen depending on the drive power received by the drive motor of the compressor. The lifting force exerted by the lifting device is thus not determined, or at least not exclusively determined, according to the results of the compression or the delivery values of the gas achieved, such as suction or final pressure, flow quantity, etc., but at least in the sensitive range with the highly throttled delivery rate also depending on the power respectively received by the drive motor, for example an electric motor. The control thus takes place due to the determination or monitoring of the power used for driving the compressor system. The motor output is simple to ascertain and evaluate as a control quantity. Since the influence of the gas properties on the motor output is furthermore substantially less than on the lifting force, a further essential advantage of the invention is extensive independence of the entire control of the respective properties of the gas delivered.

In a further embodiment of the invention, the lifting force can be restricted depending on the drive power so that in the direction of a reduction of the delivery rate, it is varied solely up to a given minimum drive power. A lower limit of the drive power is thus determined, in which case on falling below the latter, no further variation, for example increase of the lifting force, takes place. Consequently, the compressor is prevented in a simple manner from being switched suddenly to idling by the lifting device. The possible control range can be fully utilised in this way independently of the gas properties, because the limit value of the lifting force is adapted automatically to the properties of the gas just conveyed. In the case of highly variable pressures, even a suction pressure or final pressure compensation may be superimposed.

In a preferred embodiment of the method according to the invention, the lifting force within the entire control range depending on a predetermined control signal is formed as the reference value and depending on the drive power respectively received by the drive motor is formed as the actual value, in which case it is increased in the case of drive power lying above the reference value and reduced in the case of drive power lying below the reference value. Consequently, when delivering gases with a different and continuously varying molecular weight, not only the full utilisation of the control range is possible, but a largely linear relationship results between the control signal and the resulting delivery rate over the entire control range. The at least approximately linear relationship simplifies the entire control sequence and the actuation both when determining the reference value manually as well as automatically.

A simple implementation of the method according to the invention may take place in this case due to the face that the lifting force is formed from the difference between the control signal as a reference value and a signal corresponding to the drive power as an actual value. This variation is simple to implement, because only one device is necessary for forming the difference between the two signals. Furthermore, for limiting the lifting force, the control signal given as the reference value can be limited, due to which the lifting force is simultaneously prevented from exceeding a desired limit value.

A device for carrying out the method according to the invention consists in that preceding the lifting device is a pressure-limiting valve for limiting the lifting force, to which a limiting signal is supplied, which is similar to the drive power respectively received by the drive motor of the compressor system. With this arrangement, the entire delivery of the compressor is prevented from being shut off if a predetermined minimum delivery rate is not reached.

In a further, preferred device for carrying out the method according to the invention, in which the magnitude of the lifting force is determined by a controller, the controller receives a predetermined control signal as the reference value and an input signal similar to the drive power received by the drive motor of the compressor system, as the actual value. From these two signals, the controller forms a lifting pressure signal, which is supplied to the individual lifting devices of the compressor system. As an essential feature, this device is also based on the finding that the drive power respectively received by the drive motor of the compressor is largely independent of the gas properties, in particular of the molecular weight of the gas delivered, but has a linear relationship with the delivery rate. Thus, by using the respectively received drive power for controlling the compressor system, a control curve extending at least approximately in a linear manner and furthermore an extensive independence on the gas properties is achieved. The shutting-off of the delivery, on falling below the lowest possible delivery rate, can in this case also be prevented due to the fact that a limit value corresponding to the lowest admissible delivery rate is provided for the reference value.

Within the scope of the invention, the controller may be preceded by a range switch with a branch for the control of an additionally provided overflow control, for example a bypass valve, on reaching the predetermined limit pressure, the range switch controls the additional overflow control and actuates for example a bypass valve. In this way it is possible to regulate the delivery rate of the compressor system down further than is possible solely with the return flow control.

Adjustable boosters may be incorporated in the lifting pressure lines leading to the individual lifting devices. The necessary lifting force may then be adjusted individually for each lifting device. In practice it is sufficient if only part of the lifting devices is provided with such a booster.

In multi-stage compression, the device according to the invention may be further developed due to the fact that an intermediate pressure controller is provided for controlling the second and/or a higher compression stage of the compression system, which controller adapts the lifting force to the respective intermediate pressure and the relationships in the respective compression stage.

BRIEF DESCRIPTION OF THE DRAWINGS

In the following description, the invention is described in detail with reference to embodiments illustrated in the drawings.

DETAILED DESCRIPTION

Figure 1:
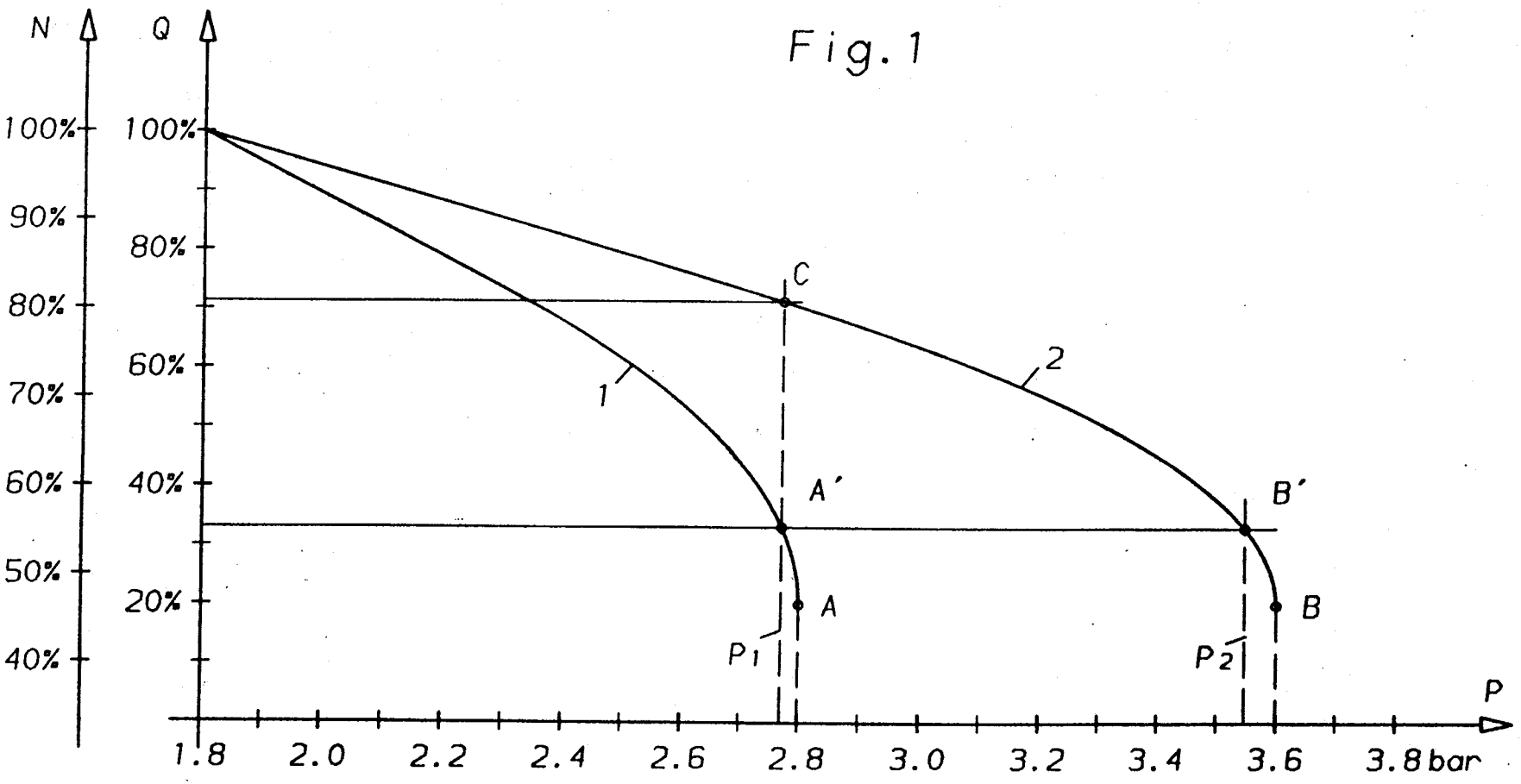
FIG. 1 shows a diagram, in which the course of the delivery rate and of the motor output corresponding thereto, depending on the lifting pressure supplying the lifting force, is illustrated in the case of different gas properties.

In the diagram according to FIG. 1, the lifting pressure p in bars is plotted on the x-axis and the delivery rate Q in percent is plotted on the y-axis. In addition, parallel to the y-axis, the drive power N likewise in percent of the motor output received at the time of full delivery, is illustrated. The two curves 1 and 2 show the course of the delivery rate Q depending on the lifting pressure p when delivering gases with different properties. The curve 1 illustrates for example the course in the case of a gas with a molecular weight $M=2.7$ and the curve 2 when delivering a gas with a molecular weight $M=6.2$. This illustration also shows that the drive power N increases in an approximately linear manner with the delivery rate, the idling power in the case of zero delivery amounting for example to 33% of the full drive power.

From the shapes of the curves 1 and 2 it can be seen that an increase in the lifting pressure p results in a continuous reduction of the delivery rate Q. This is true up to a point A on the curve 1 and a point B on the curve 2. If the lifting pressure is increased only slightly beyond the points A or B, the delivery rate immediately jumps to zero. The flow forces exerted on the valve closure members by the gas flowing back through the suction valves are no longer sufficient to close the suction valves against the lifting force applied thereto. In order to avoid this sudden shutting-off of the delivery quantity, which not only causes surges in the gas circuit, but also current surges in the electrical mains, the control range must be restricted to the continuously developing part of the curves 1 and 2. This was achieved hitherto by limiting the lifting pressure p to a fixed value, which lies just below the pressure of 2.8 bars, which is associated with the point A. In FIG. 1, this limit pressure is shown in broken line and designated by the reference $p_1$.

The straight line representing the limit pressure $p_1$ intersects the curve 2 at the point C, which corresponds to a delivery rate of approximately 70%. If, at this setting, thus with a lifting pressure $p_1$, a gas of higher molecular weight is delivered, for example according to the curve 2, then the continuous control is restricted to the region of the curve 2 lying above the point C. The control is thus reduced to a region between 100 and about 70%. In order to utilise the entire, possible control range into the vicinity of the point B, the lifting pressure restriction must be adjusted to a higher limit value $p_2$, in the embodiment for example to a pressure of approximately 3.55 bars. When delivering gases having a fluctuating molecular weight, the molecular weight must thus be measured constantly and the lifting pressure limitation must be adapted automatically to the molecular weight measured, corresponding to the existing physical relationship. This is extremely complicated, since the instruments for determining the molecular weight are expensive.

The invention is based on the fact that the drive power of the motor driving the compressor system, in accordance with the compression work, is independent of the molecular weight, but has a linear relationship with the delivery rate. Using this finding, according to the invention, the lifting pressure is limited depending on the drive power, in the embodiment according to FIG. 1 for example, to the value which corresponds to the delivery rate of approximately 33%. With this one adjustment, the limitation for both types of gas takes place just before the points A and B on the curves 1 and 2. In FIG. 1, these two limiting points are designated by the references A' and B'. This limitation is valid for all gases and molecular weights between the two curves 1 and 2 and also outside the latter, without the molecular weights having to be measured. Nevertheless, in all cases, the entire control range available between 33 and 100% can be utilised.

In one variation of the method according to the invention, the virtually linear relationship between the delivery rate Q and the drive power N is utilised for simplifying and facilitating the control. By specifying the reference value for the drive power N as a control signal, a linear relationship between this control signal and the delivery rate Q achieved can be attained. In this case, the lifting pressure is formed so that the actual drive power is used as an actual signal and that by means of a control device, this actual signal is approximated as far as possible to the given control signal as a reference value. In this embodiment, the limitation of the control takes place by limiting the control signal to a drive power N, which corresponds to approximately 33% of the delivery rate Q.

Figure 2:
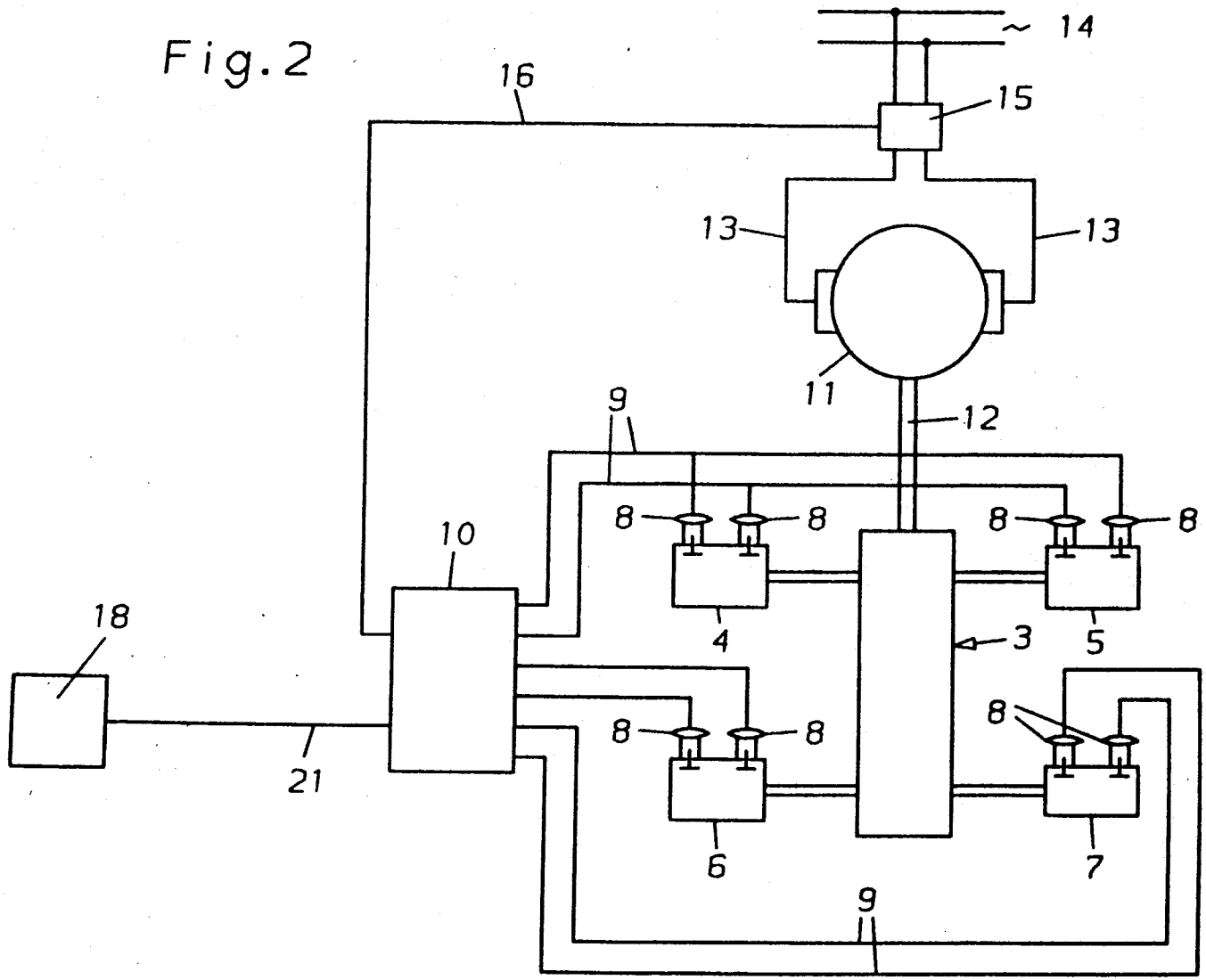
FIG. 2 is a diagrammatic circuit diagram of a compressor system, which is controlled according to the method of the invention

The compressor system 3 illustrated in FIG. 2 consists of a compressor with four cylinders 4, 5, 6 and 7 acting on two sides. The two cylinders 4 and 5 jointly form the first compression stage, the cylinder 6 is the second stage and the cylinder 7, having a somewhat smaller construction, forms the third compression stage. Associated with each cylinder 4 to 7 on each cylinder side is a lifting device 8, which acts on the suction valve shown only diagrammatically. Thus, each cylinder 4 to 7 is provided with two lifting devices 8. The lifting devices 8 are connected to a controller 10 by way of lifting pressure lines 9 associated therewith.

The compressor system 3 is driven by a common drive motor 11. It is an electric motor, which is connected by way of a drive shaft 12 to the compressor system 3 and is supplied with power by way of an electrical supply line 13 from alternating-current mains 14. Incorporated in the supply line 13 is an output meter 15, for example a wattmeter, which continuously measures the drive power received by the drive motor 11 and transmits it by way of a measuring line 16 to the controller 10.

In FIG. 2, a switching station 18 is also shown, in which—either manually by the operator or automatically by a control or regulating device—a signal corresponding to the desired delivery rate of the compressor system 3 is produced, which is supplied by way of a control lead 21 to the controller 10. The controller 10 compares the control signal supplied as a reference value with the actual value supplied thereto by way of the measuring lead 16 from the wattmeter 15. If the actual value varies from the reference value, the controller varies the lifting pressures for the purpose of bringing the actual value closer to the reference value, or it limits the lifting pressures depending on the motor output. The lifting pressure is supplied by way of the lifting pressure lines 9 to the lifting devices 8 at the suction valves of the individual cylinders 4–7.

Figure 3:
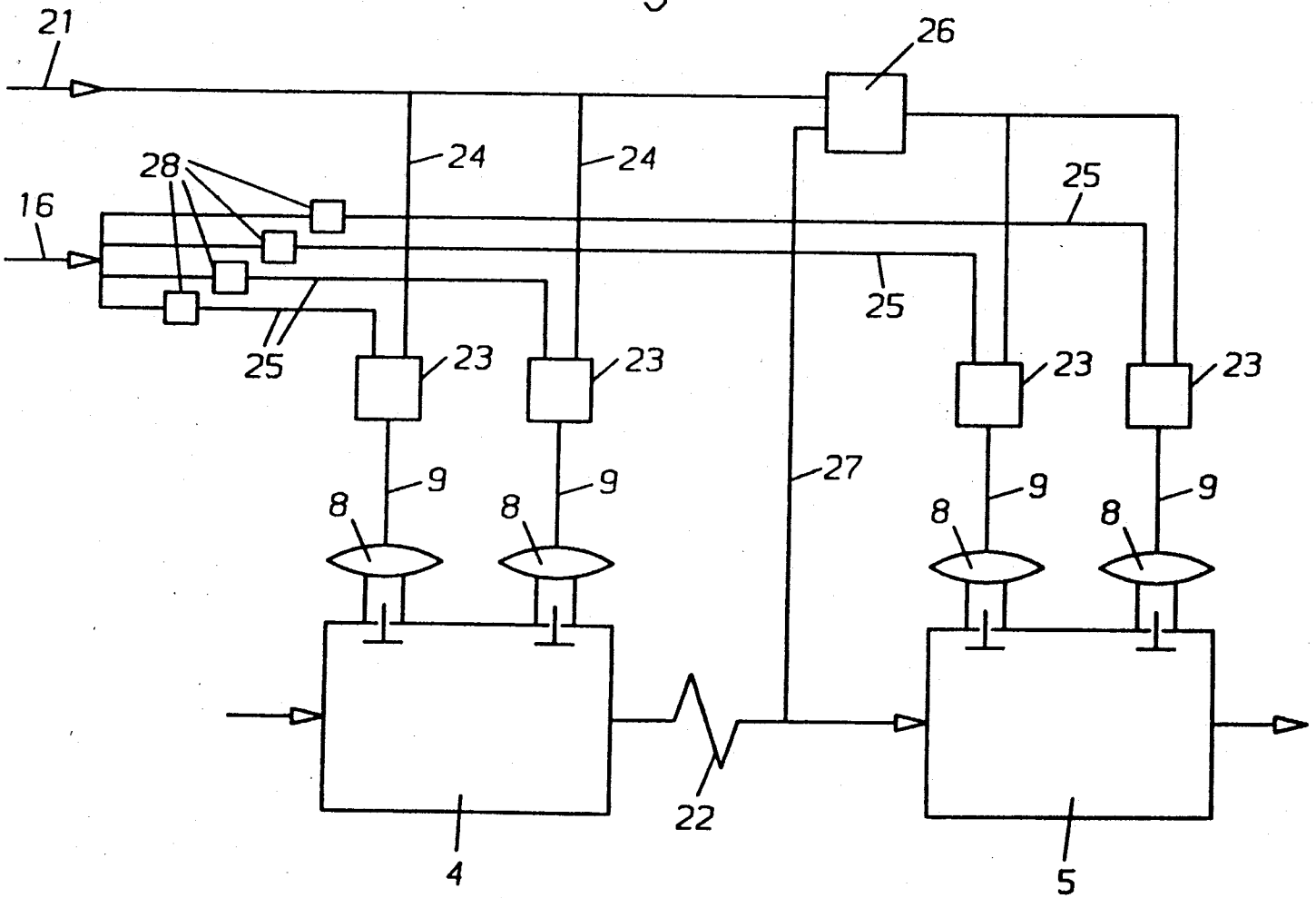
FIGS. 3 and 4 are each circuit diagrams of embodiments of the control device, by way of example.

In the circuit diagram illustrated in FIG. 3, the drive power of the drive motor (not shown) of the compressor system is used as a basis for limiting the lifting force. The two cylinders 4 and 5, which are connected to each other by way of an indicated intermediate cooler 22, form a first and a second compression stage. The suction valves of both stages are each provided with a lifting device 8, to which the lifting pressure is supplied by way of lifting pressure lines 9. The latter is supplied by way of pressure-limiting valves 23, which each precede the lifting pressure lines 9. Leading to each pressure-limiting valve 23 are two control lines, a control signal lead 24 and a power signal lead 25. A control signal corresponding respectively to the volumetric flow delivered by the compressor system is supplied by way of the control signal lead 24, whereas the power signal lead 25 supplies a signal, which corresponds to the driving power respectively received by the drive motor of the compressor system. The pressure-limiting valves 23 respectively transmit the smaller signal, due to which the compressor system is prevented from being switched accidentally to idling in the case of greater throttling of the delivery.

It is also apparent from FIG. 3 that incorporated in the control signal lead 24 is an intermediate pressure regulator 26, which by way of a lead 27 takes into consideration the intermediate pressure in the intermediate cooler 22 between the two compression stages. Boosters 28 are incorporated in the signal leads 25 adjoining the measuring lead 16, by way of which a signal similar to the drive power is supplied. An individual booster 28 may precede each pressure-limiting valve 23. It is thus possible to adjust the lifting pressure separately for each individual lifting device 8, which is possibly necessary if the individual compression stages or compressor sides work with different, effective piston surfaces.

In this circuit, the control signal supplied by the process control system by way of the lead 21, which determines the respectively desired delivery rate of the compressor (reference value) is converted directly into the lifting pressure and supplied by way of the signal leads 24 and the pressure-limiting valves 23 to the lifting devices 8 of the individual cylinders 4, 5. The intermediate pressure regulator 26 in this case takes into consideration and compensates for the different relationships in the second compression stage. As soon as the lifting pressure caused by the control signal supplied exceeds the pressure which is supplied to the pressure-limiting valves 23 by way of the power signal leads 25, the pressure-limiting valves 23 block the control signal leads 24 and supply to the lifting devices 8 the constant pressure regulated by the boosters 28. Thus the lifting pressure is limited to a value which can be selected freely and adjusted simply, which cannot be exceeded.

With this measure, with the correct adjustment of the limiting pressure on the one hand, it is reliably prevented that the delivery of the cylinders 4, 5 is shut off completely accidentally, on the other hand, due to the adaptation of the limit value of the lifting pressure to the drive power respectively received from the compressor, an adaptation to the properties of the respectively delivered gas, in particular to the molecular weight is achieved, so that for each molecular weight, the full control range can be utilized.

Figure 4:
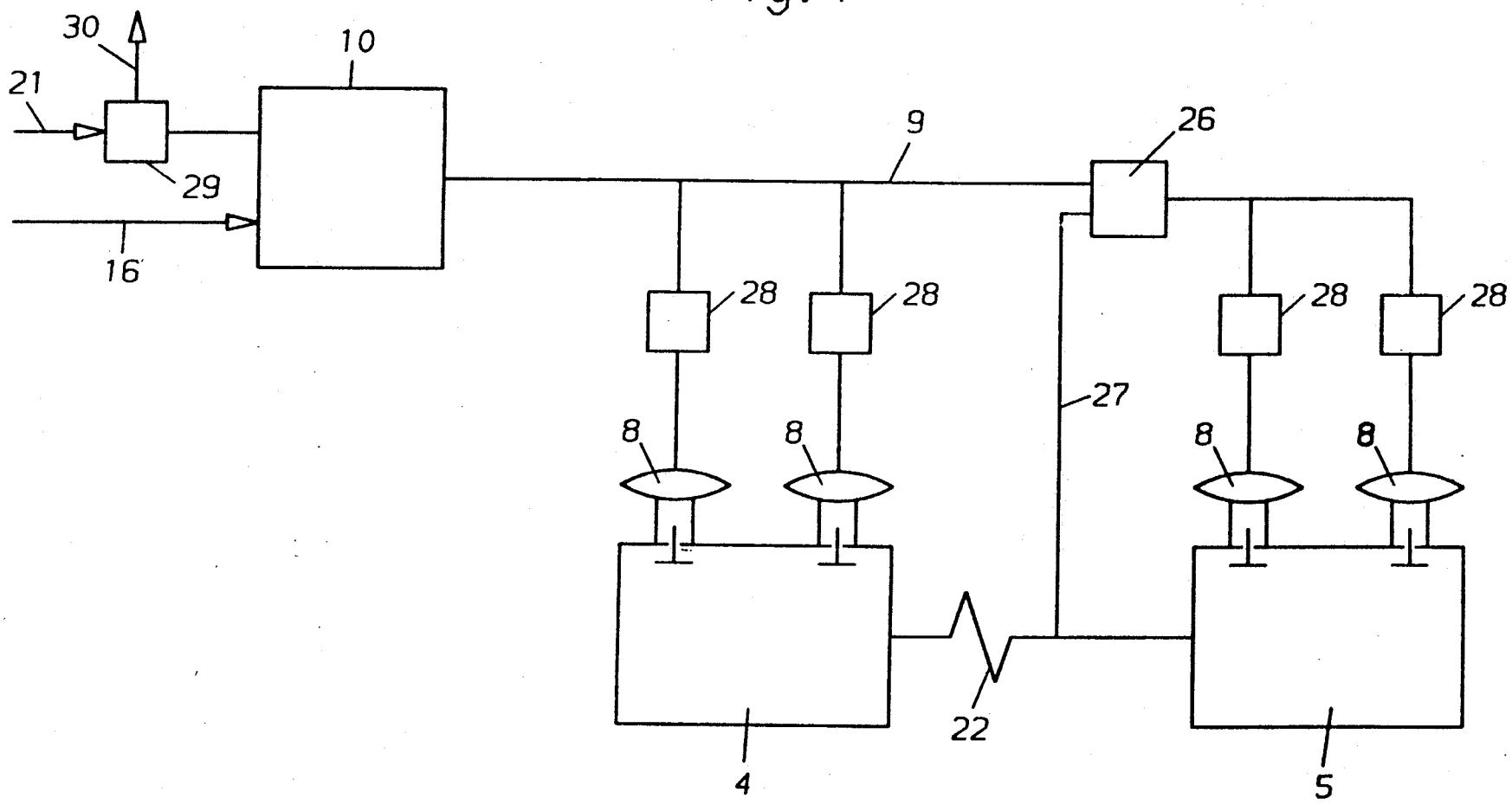

The embodiment of the control device illustrated in FIG. 4 differs from the circuit according to FIG. 3 substantially due to the fact that the control signal is not converted directly into the lifting pressure, but is used as a reference value for the drive power of the driving machine driving the cylinders 4, 5. In a manner similar to the circuit illustrated in FIG. 2, the control signal, for example a quantitative signal is supplied by the control station designated by the reference 18 in FIG. 2, by way of the lead 21 to the controller 10. Furthermore, the latter also receives a signal corresponding to the respective drive power, by way of the measuring lead 16. The controller 10 converts the two signals into a lifting pressure signal, which is supplied by way of the lifting pressure line 9 and the adjoining branches to the lifting devices 8 of the individual cylinders 4, 5. In this embodiment also, the cylinder 4 forms the first stage and the cylinder 5 the second compression stage. Incorporated between the two stages is an intermediate pressure regulator 26, which by way of the line 27 compensates for the changed ratios in the second stage.

Incorporated in the respective lifting pressure lines 9 are boosters 28, in order to be able to adapt the lifting pressure individually to the requirements of the respective cylinder side and of the associated lifting device 8. For this purpose, it may also suffice, if a booster 28 respectively precedes only one lifting device 8 in each compression stage. Finally, incorporated in the control lead 21 in front of the controller 10 is a range switch 29, from which a branch 30 leaves, by which an additional control device can be controlled, for example at the time of a smaller delivery, for regulating the delivery rate outside the control range of the return flow control. This may be a by-pass control for example, the by-pass valve being controlled by the signals supplied by the branch 30.

With the signal processing by the circuit according to FIG. 4, a largely linear relationship automatically results between the control signal supplied by way of the control line 21 and the delivery rate. This allows a substantial simplification of the control of the compressor system, irrespective of whether the latter is carried out manually or automatically, for example takes place by way of a process computer.

I claim:

1. In a method for stepless control of a gas delivery rate of reciprocating compressors having at least one compressor cylinder which includes a suction opening, and a lifting device which is actuated by a lifting force supplied by a pressure medium and acts by retarding at every piston stroke or cycle the closing of the suction valve by varying the force holding the valve open, the improvement comprising measuring electrical power consumed by the drive motor of the compressor, and as a function of the electrical power consumed by the drive motor of the compressor, controlling magnitude of the lifting force at least in a range of smallest delivery rate able to be achieved by the control, and wherein controlling the magnitude of the lifting force is independent of properties of the gas delivered.

2. A method according to claim 1, including limiting the lifting force depending on the power consumption of the drive motor, so that it is varied in a direction of a reduction of delivery rate solely up to a predetermined minimum drive power consumption of the drive motor.

3. A method according to claim 1, including forming the lifting force within the entire control range depending on a given control signal as a reference value and on the power consumption of the drive motor as an actual value, in which case it is increased in the case of a power consumption lying above the reference value and reduced in the case of a power consumption lying below the reference value.

4. A method according to claim 3, including forming the lifting force from the difference between the control signal as a reference value and a signal corresponding to the power consumption as an actual value.

5. A method according to claim 1, including limiting the lifting force by limiting the control signal supplied as the reference value.

6. A reciprocating compressor system which includes a reciprocating compressor having at least one cylinder which includes a suction opening and a movable suction valve for opening and closing said suction opening, an electrically powered drive motor for driving said reciprocating compressor, a meter for measuring the electrical power supplied to said drive motor, and a lifting device operable by a pressure medium for lifting said suction valve to allow entry of a gas, a pressure line connected to said lifting device, and a pressure-limiting valve to which said pressure line is connected for limiting the pressure of said pressure medium based on electrical power signals emitted by said meter during a period of low delivery rate of said reciprocating compressor, said power limiting valve adapted to control the lifting device independently of properties of said gas.

7. A reciprocating compressor system according to claim 6, wherein said system further comprises means for supplying a predetermined control signal as a desired reference value to said controller so as to supply signals thereto derived from the measured electrical power consumed by said drive motor as an actual value.

8. A reciprocating compressor system according to claim 7, including a range switch which receives said signals from said meter, said range switch including a branch which is connected to a by-pass valve.

9. A reciprocating compressor system according to claim 7, including an adjustable booster connected to said pressure line.

10. A reciprocating compressor system according to claim 7, including a plurality of said cylinders for multi-stage compression, and including a pressure regulator for regulating a second or higher compression stage.

* * * * *